United States Patent [19]

Lesieur

[11] Patent Number: 4,867,827

[45] Date of Patent: Sep. 19, 1989

[54] PROCESS FOR GOLD FOIL STAMPING IN RELIEF

[76] Inventor: Frederic Lesieur, 25, Rue Pradier, Paris, France, 75019

[21] Appl. No.: 294,891

[22] Filed: Jan. 3, 1989

Related U.S. Application Data

[63] Continuation of Ser. No. 076,136, Jul. 21, 1987, abandoned.

[30] Foreign Application Priority Data

Jul. 28, 1986 [FR] France ..... 86 10876

[51] Int. Cl.[4] ..... B44C 1/14

[52] U.S. Cl. ..... 156/241; 101/32; 156/233; 427/197; 427/203; 427/265

[58] Field of Search ..... 156/233, 234, 235, 241, 156/283; 427/197, 203, 265; 101/32, 27, 25; 118/46, 202, 211

[56] References Cited

U.S. PATENT DOCUMENTS

| | | | |
|---|---|---|---|
| 1,744,829 | 1/1930 | Dreyfus | 101/25 X |
| 3,440,076 | 4/1969 | Vaurio | 427/197 X |
| 4,079,673 | 3/1978 | Bernstein | 427/197 X |
| 4,724,026 | 2/1988 | Nelson | 156/234 |

FOREIGN PATENT DOCUMENTS

| | | | |
|---|---|---|---|
| 2735138 | 2/1979 | Fed. Rep. of Germany | 101/32 |
| 34739 | 9/1974 | Japan | 427/203 |
| 47054 | 4/1977 | Japan | 427/197 |

*Primary Examiner*—Clifford D. Crowder

*Attorney, Agent, or Firm*—James E. Bradley

[57] ABSTRACT

Gilding or relief-marking process which starts with any typographic, offset or other impression and converts it into relief of variable thickness, by the known thermography principle, but employing a hot-melt powder endowing the film forming the relief with adhesive properties capable, after it has solidified, of transferring and retaining on its surface a marking material.

10 Claims, 3 Drawing Sheets

PROCESS FOR GOLD FOIL STAMPING IN RELIEF

This application is a continuation, of application Ser. No. 076,136, filed 07/21/87, now abandoned.

CLAIM OF FOREIGN PRIORITY

Applicant claims foreign priority benefits under Title 35, U.S. Code for French patent application No. 8610876, filed July 28, 1986.

FIELD OF THE INVENTION

Gilding, printing or hot-marking is a process which is known and which is employed in various industries such as the printing industry, the manufacture of cardboard articles, the manufacture of plastic articles, binding workshops and the like.

BACKGROUND OF THE INVENTION

In its outlines, the principle of marking is as follows:

A roll consisting of a polyester film is coated on one face with a fine, metallic or otherwise, marking layer, onto which a hot melt adhesive capable of being activated when hot is then deposited. During the marking operation, a gilding stamp whose relief portions represent the image to be marked is heated and pressed against the marking film and the receiving substrate. Only the portions of the film and of the receiving substrate in contact with and pressed by the relief portions of the gilding stamp are heated, and this permits the adhesive which is activated in these regions to adhere and to bond with the marking foil onto the receiving substrate. At each cycle, the transfer of the marking layer, from the film onto the receiving substrate, takes place when the pressure is released and when, on opening, the press moves the film away from the substrate.

When this process first originated, the metal film was made of gold leaf. Nowadays, very frequently, the tape is metalized under vacuum and gold is replaced with colored aluminum. Various pigments or decorative marking substances are sometimes substituted for the metal film. The manufacturers of these marking films offer the users a range of products whose decorative and highly elaborate effects find countless applications.

All sorts of presses with platens or rolls are equipped for performing this hot marking and include devices allowing the tape to move past intermittently, with a forward motion which can be varied as a function of the length of the pattern to be reproduced, and systems for heating the marking stamp and maintaining its temperature.

The pressure required to produce the transfer of the marking layer onto a receiving substrate of the card type is of the order of 250 kg/cm$^2$.

In many cases in order to improve the decorative effect and the legibility, repoussé work on the substrate, in the marked portions, enables them to stand out in relief. The technique which is employed at the present time gives very good results insofar as the quality produced is concerned, but includes a certain number of major defects due to the basic principle of the process and to the means required to implement it.

These defects can be defined as follows:

a transfer machine, press or heated roll, which is very heavy, relatively cumbersome and representing a major investment, high cost of the materials to be employed, such as gilding stamps or repoussé tools, reflected in the cost of manufacture of the printed matter and very difficult to incorporate in its sale price, chiefly in the very frequent cases of print runs involving few copies, lack of flexibility in use and excessively long processing time, restricting its development potential, and the need to employ extremely highly qualified operators, since the latter are often confronted with a set of difficulties to be overcome in order to produce a high-quality marking.

Overall, these difficulties can be listed as follows:

relative uneveness of thickness in different regions of one and the same substrate, surface quality which varies between one substrate to be marked and another, pressure phenomena which are very frequently difficult to control fully and chiefly in platen presses, where it is very tricky to obtain a perfect pressure distribution and chiefly when the problem is to treat simultaneously patterns comprising large impression surfaces close to fine lines, generally mediocre temperature distribution in the heated platens to which the marking blocks are fastened, resulting in defects in the transfer of the marking foil, and relatively very low hourly production.

Furthermore, and in order to appreciate properly the care required to produce satisfactory marking, what must be known is that the marking film and the very thin layer of hot-melt adhesive with which it is coated both have a thickness of the order of one micron and, in most cases, tolerate only very narrow temperature and pressure deviations. Moreover, the repoussé work for producing relief is also a matter for an expert, because this extremely tricky operation calls for reliable experience, chiefly when using marking stamps which enable gilding and repoussé work to be performed simultaneously.

SUMMARY OF THE INVENTION

The subject of the present invention is an extremely simple process which enables any printer at all to produce relief impressions whose surface is coated with the same type of marking foil as is usually employed.

According to the present invention, the production of the relief impression is performed by starting with the known principle of thermography, with modification of the powdered materials which are usually employed, by means of materials which have particular adhesive properties. The relief impression is then coated with a conventional marking foil whose transfer from its support tape is carried out by making use of the adhesive properties of the film forming the relief image.

DESCRIPTION OF THE PREFERRED EMBODIMENT

Figure 1:
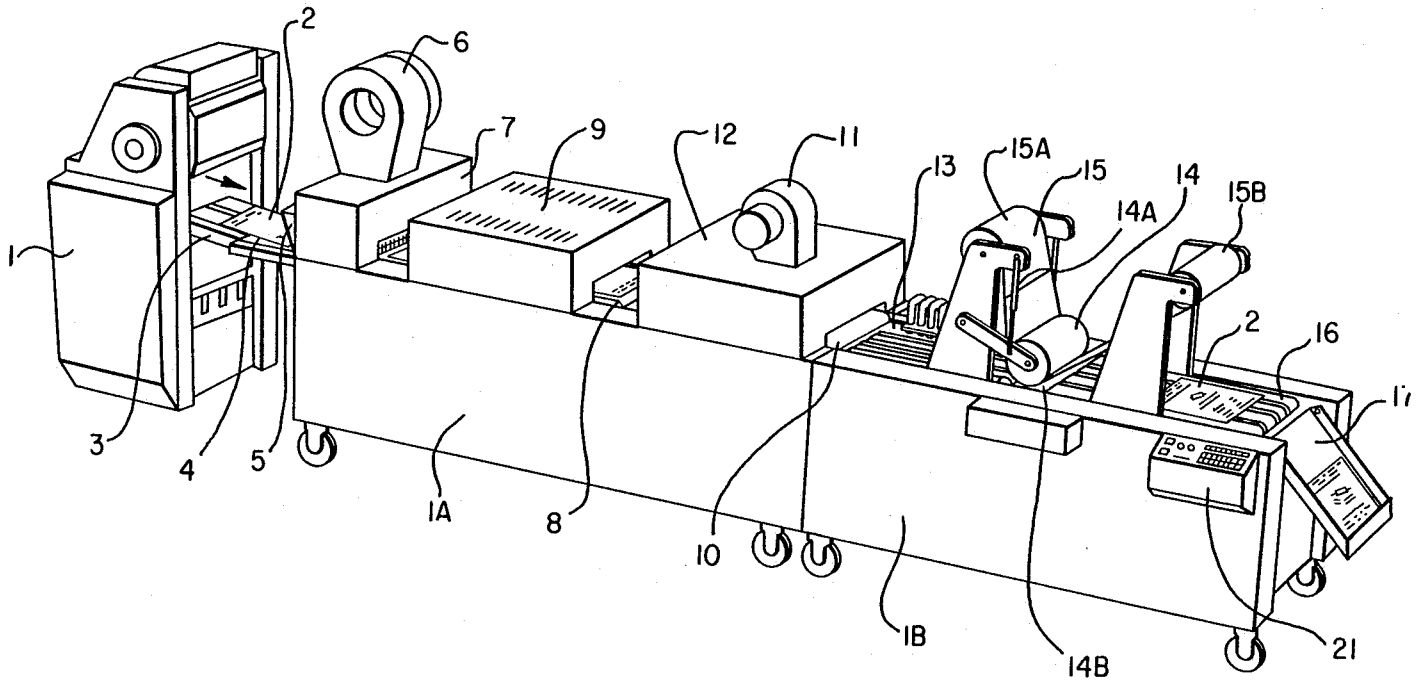
FIG. 1 is a perspective view of the stamping system in accordance with the present invention.

In its broad outlines, the operation is carried out as follows:

(1) Traditional printing which, depending on the receiving substrate, may be wet offset, dry offset, typographic, silk-screen, flexographic, heliographic, and the like. The only criterion to be observed is that the ink, printing varnish or superimposition varnish or other material which has been used to form the image to be converted into relief, should be moist at the surface.

(2) Conversion of this impression into relief using the known thermography principle which consists in sprinkling a flat impression, the ink of which is still moist, with a hot-melt powder having the property of melting under the effect of heat which is generally associated with that of an infrared radiation to form a semiliquid relief film, which sets on passing under a jet of cold air in order to prevent its distortion and the mutual adhesion of the leaves when they are stacked one on top of another. The excess powder which is not retained by the moist ink is continuously removed by suction and recycled. The present invention, while employing the thermography principle for its relief impression, introduces a major variant in respect of the powdered materials which are conventionally employed in this process.

In fact, the powders which are usually employed in thermography must have physical characteristics which enable them to withstand a major temperature rise, without their surface being in a tacky state, so as to avoid any risk of mutual adhesion between the sheets. The adhesiveness of these powders appears when they enter a semiliquid phase.

These properties are contrary to those required for the application of the process forming the subject of the present invention, where the adhesiveness of the relief film must be produced after its solidification, while it maintains or returns to a surface temperature of the order of 50° centigrade. It must also maintain its adhesiveness in a semiliquid state when powders of small particle size are employed.

(3) Surface coating of the relief image with any conventional marking substance whatever, whose transfer takes place by virtue of the hot-melt adhesive properties of the relief film, generally accompanied by a light calendering operation performed using a flexible material. In this process, the hot-melt adhesive coating the marking substance of the films which are usually employed becomes useless, but can be retained, if desired, because its adhesive activity is produced at a much higher temperature than that of the relief layer and, consequently, remains inert and does not take part in the transfer stage of the marking material.

In the production of a thermography impression, the minimum particle size which is generally employed is of the order of fifty microns. This is not the case in the present invention, where it is possible to produce an impression coated with a marking material with practically no relief, by starting with a powder whose mean particle size will be between five and twenty microns, giving a rolled film of the order of five to ten microns, depending on the porosity of the substrate. In this case of application of the process, a long tunnel oven is avoided, because the melting and the film-forming state of the fine layer of powder may be produced simultaneously by calendering at a low heat during the transfer operation, or cold calendering with a slight preheating of the powdered impression.

One of the essential differences which characterize the present invention lies in the fact of maintaining on the surface of the substrate, an adhesive layer forming the image to be reproduced by marking, of a variable thickness which is always sufficient, whatever the porosity of the article to be marked, to produce easy transfer in all circumstances. This is not possible in the process which is usually employed, because the hot-melt film is intimately bonded to the marking material which it coats and, as a result, can barely exceed one micron in thickness, at the risk of causing an erratic peeling and tearing away of the marking material when it is transferred, giving a poor definition of the outlines of the image on the receiving substrate. This constraint is reflected in the need to employ relief frames and very high pressures of the order of 250 kg/cm$^2$ for the transfer.

The process which forms the subject of the present invention requires average pressures of the order of 1 to 2 kg/cm$^2$.

One of the operating procedures of the process is described hereinafter, by way of example without implying any limitation, with reference to the attached drawings.

An offset printing press 1, FIG. 1, deposits printed matter 2 on the feed conveyor 3 of a thermography machine 1A. In succession, this printed matter 2 passes over the powdering conveyor 4, where its entire surface is coated with a thin layer of powder from the powder trough 5. The cyclone 6 continuously sucks away and recycles into the powder trough 5 the surplus powder which is not retained by the moist ink. On leaving the powdering unit 7, the printed matter which is powdered only in the impression regions continues its journey and is carried by the melting conveyor 8 into the tunnel oven 9, where the powdery image is converted into an image coated with a relief film in a semiliquid state, which is solidified on the cooling conveyor 10 by the action of the cold air driven by a variable flowrate turbine 11, blowing inside the perforated casing 12. The printed matter 2 whose thin relief layer is solidified but whose adhesiveness is still very high then travels over the feed conveyor 13 of the transfer device 1B and under the pressure roll 14, where the marking tape 15 is applied onto the printed matter 2 to perform the transfer of the marking material. The conveyor 16 carries the "marked" printed matter to the delivery tray 17.

Figure 2:
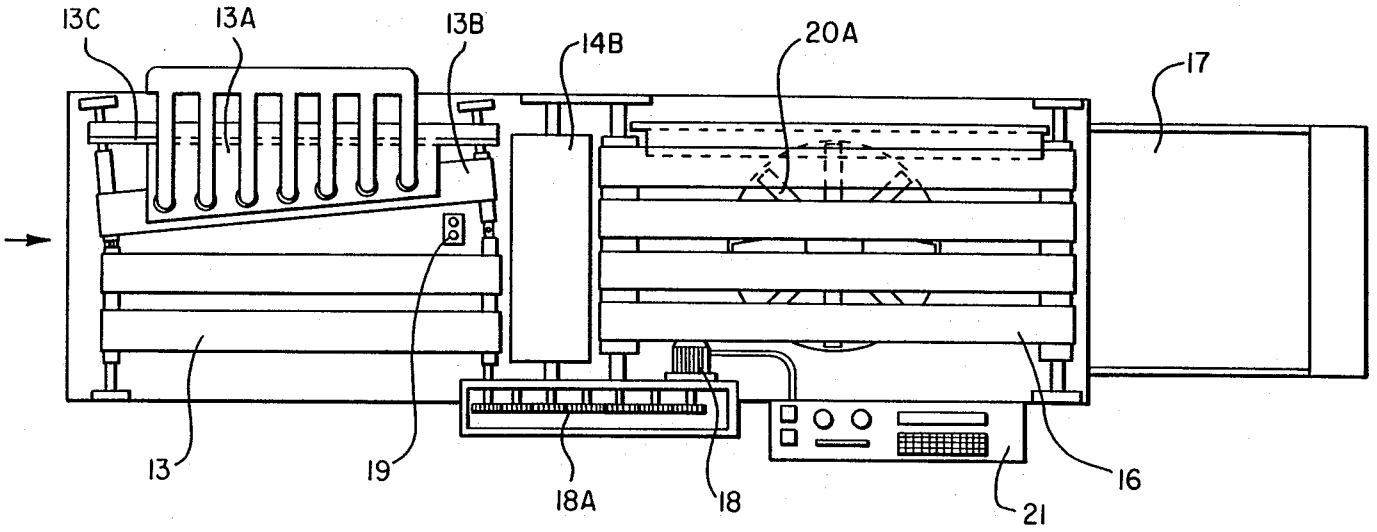
FIG. 2 shows a top view of the feed and exit conveyors of the device for transferring the marking material.

FIG. 2 shows a top view of the feed and exit conveyors of the device for transfering the marking material.

Figure 3:
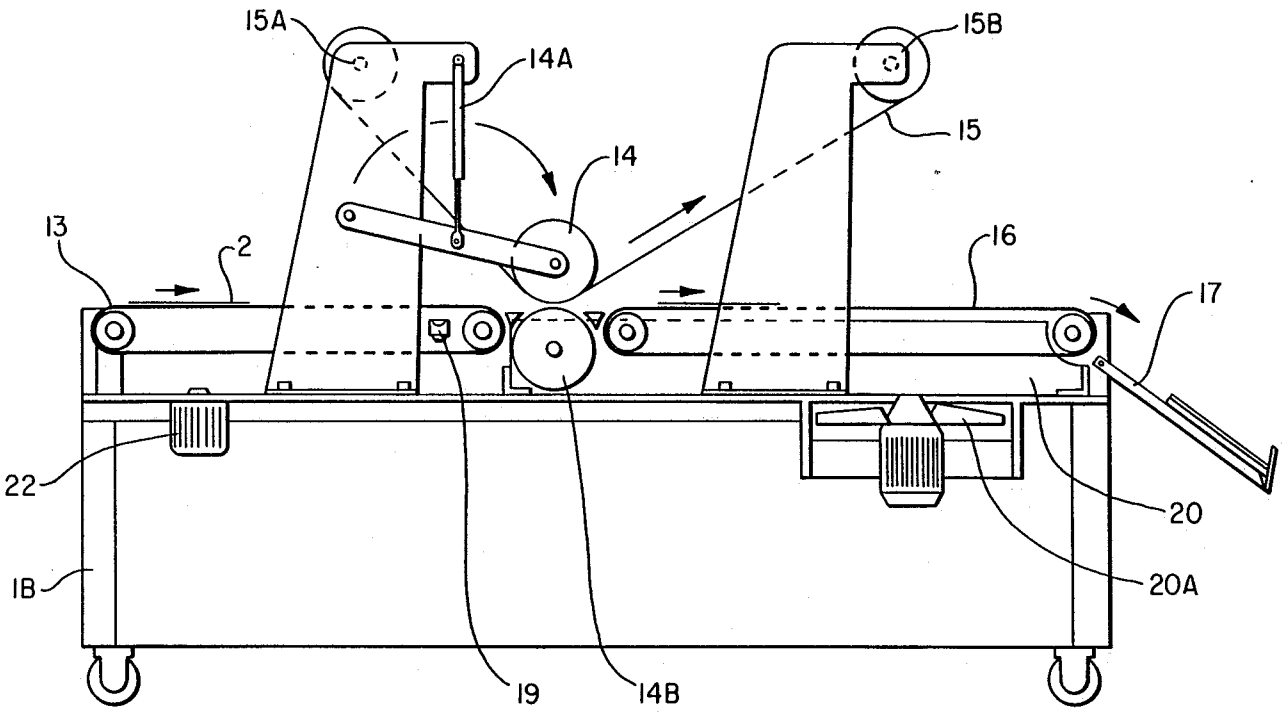
FIG. 3 shows a front view of the whole transfer device.

FIG. 3 shows a front view of the whole transfer device.

These 2 figures aid in understanding the detailed working of the marking operation, which is defined as follows:

The printed matter, converted into relief, and with its film still viscous, is picked up, after its mass has solidified, by the feed conveyor 13, FIGS. 2–3. The pneumatic jogger 13A, FIG. 2, bears, by means of jets of compressed air at a low pressure (approximately six bars), on the oblique belt 13B, FIG. 2, in order to straighten and guide the paper onto the guide 13C, FIG. 2. The assembly of conveyors and rolls responsible for moving the belt forward is driven by a stepping motor 18, FIG. 2, or a d.c. motor equipped with a coder controlled by an electronic device which can be programed as a function of the location of the marking regions of the printed matter to be treated. A gear train 18A, FIG. 2, is responsible for linking the drive of the various components for conveying the printed matter. An optical sensor 19, FIGS. 2–3, detects the arrival of the guided printed matter 2 and triggers the marking cycle according to the established program. The marking cycle comprises the following functions, which are executed simultaneously:

(a) Forward movement of the virgin marking tape 15, FIG. 3, reeled beforehand and supported by the pivot of the unwind device 15A, FIGS. 1–3, which is driven by the windup hauloff 15B, FIGS. 1–3, recovering the used tape 15 on a reel, (b) the virgin marking tape 15, FIGS. 1 and 3, passes under the resilient pressure roller 14, FIGS. 1 and 3, whose pressure is exerted by means of the pneumatic jack 14A, FIGS. 1 and 3, on the counterpressure roller 14B, FIGS. 1, 2 and 3. The counterpressure roller 14B and the exit conveyor 16, FIGS. 1, 2 and 3 are under partial vacuum by means of the suction casing 20, FIG. 3, equipped with a helical turbine 20A, FIGS. 2 and 3, so as to lay and keep the printed matter 2 flat throughout and on leaving its marking, so as to produce an accurate separation of the marking layer. The delivery tray 17, FIGS. 1, 2 and 3, recovers the printed matter when the treatment is finished. The digital control panel 21, FIGS. 1 and 2, permits each new type of printed matter to be programed. The compressor 22, FIG. 3, feeds the air jets 13A, FIG. 2, of the feeder and the pneumatic jack 14A, FIGS. 1 and 3.

In the case where the printer wishes to produce the relief by means of conventional repoussé work, it is sufficient for him to start with a printed matter in which the marking transfer is produced using powder of small particle size. It is quite obvious that, without departing from the scope of the present invention, the activation of adhesiveness of the film forming the relief may be produced by means other than heat, using, for example, a hot-melt powder whose surface adhesiveness will be activated by moisture.

Depending on the applications, the particle size of the powder is not really limited, but it will nevertheless be generally between 5 and 1000 microns.

By way of an example to provide guidance, two powder formulations giving good transfer results. The first has features in common with powder formulations which are usually employed and are modified with the objective of employing the production wastes of these powders. The second is chemically very different and much lower in the cost of manufacture.

First formulation:

Known conventional polyamide whose average formulation is made up broadly as follows, per 100 on an equivalent weight basis:

fatty diacid (dimer): 71.43
stearic acid: 28.57
ethylenediamine: 100.00

To produce one kilogram of transfer material, 650 grams of this polyamide are taken and to this are added:

295 grams of rosin,
25 grams of butyl phthalate or other plasticizer,
20 grams of atactic polypropylene, and
10 grams of glycerol monostearate.

Second formulation:

A mixture, on a percentage basis, of:
styrene oleophthalic resin: 65%
acrylic resin: 15 to 20%
plasticizer of the Bayer Unimol 66 type: 10 to 15%
microcrystalline wax for controlling tack: 5 to 10%

In the case where for any particular reasons the adhesiveness was required to be activated by moisture, the acrylic resin employed could be chosen from the range of water-soluble thermoplastic acrylic resins.

A very large number of products may be formulated, as a function of local facilities and cost of supply.

The process forming the subject of the present invention will find a vast field of applications in all kinds of industry, because its basic principle endows it with great flexibility in use. It enables it to "mark" practically any substrate and material, provided that appropriate printing methods are employed and that the powders employed are formulated to produce good anchoring and sufficient mechanical strength, depending on the type of use which is intended. A whole range of applications are potentially available to it in the field of printing and the paper board industry, both in sheet printing as in continuous printing, where the thermography process is usually employed. In the case of such continuously "marked" printed matter, it is sufficient to replace the delivery tray 17, FIG. 1, at the outlet of the marking device with the equipment which is usually employed, such as a reeling unit or the like, according to the finishing treatment which is applied to such printed matter.

Furthermore, a simple ball-point pen with oily ink makes it possible to produce a drawing capable of being converted into relief by powdering and thus of being "marked" using the process which is the subject of the invention, which offers another very large potential application.

I claim:

1. A method of gilding raised images formed by a thermographic process on a substrate with a marking layer of the type releasably disposed on a backing film comprising the steps of:

providing a thermally activated adhesive powder of the type that exhibits adhesive properties while in a solidified state;

printing a selected image of the type capable of retaining said thermally activated adhesive powder on said substrate;

selectively depositing a layer of said thermally activated adhesive powder on said selected image;

heating said thermally activated adhesive powder disposed on said selected image to a temperature sufficient to melt said thermally activated adhesive powder, forming an adhesive film over said selected image; then cooling the adhesive film sufficiently to cause it to solidify but still retain its adhesiveness; then briefly pressing said marking layer disposed on said backing film against said adhesive film disposed over said selected image, causing said marking layer to bond to said adhesive film and release from said backing film.

2. The method according to claim 1 wherein said step of cooling the adhesive film is performed by blowing air onto the adhesive film.

3. The method according to claim 1 wherein said thermally activated adhesive powder comprises a mixture of polyamide, rosin, plasticizer, atactic polypropylene, and glycerol monostearate.

4. The method according to claim 1 wherein said thermally activated adhesive powder comprises on a percentage basis:

65% styrene oleophthalic resin;
15% to 20% acrylic resin;
10% to 15% plasticizer of the Bayer Unimal 66 type; and
5% to 10% microcrystalline wax.

5. The method according to claim 1 wherein said adhesive powder exhibits adhesive properties when cooled to a temperature as low as approximately 50 degrees Centigrade.

6. The method according to claim 1 wherein said selected image is printed with a varnish of the type that remains moist immediately subsequent to said printing.

7. The method according to claim 1 wherein said step of briefly pressing said marking layer disposed on said substrate against said relief film disposed on said substrate is accomplished with an average pressure of approximately 1 to 2 kilograms per cubic centimeter.

8. The method according to claim 1 wherein said thermally activated adhesive powder has a particle size in the range of 5 to 1000 microns.

9. The method according to claim 1 wherein said thermally activated adhesive powder comprises a mixture, on a percentage basis, of 65% styrene oleophthalic resin; 15% to 20% acrylic resin; 10% to 15% plasticizer; 5% to 10% microcrystalline wax.

10. A method of gilding a substrate with a marking layer of the type releasably disposed on a backing film, comprising the steps of:

providing a thermally activated adhesive powder of the type that will liquefy under a sufficient amount of heat and will exhibit adhesive properties when cooled to a solid state;

printing a selected image of the type capable of retaining said thermally activated adhesive powder on said substrate;

selectively depositing a layer of said thermally activated adhesive powder on said selected image;

heating said thermally activated adhesive powder disposed on said selected image to a temperature sufficient to melt said thermally activated adhesive powder, forming an adhesive film over said selected image which has a raised appearance; then cooling the adhesive film by discharging air on the film to a temperature sufficiently low to cause it to solidify but still retain its adhesive properties; then briefly pressing said marking layer disposed on said backing film against said adhesive film at a pressure sufficiently low to avoid flattening the raised appearance of said image, causing said marking layer to bond to said relief adhesive film and release from said backing film.

* * * * *